United States Patent [19]

Bernhard

[11] Patent Number: 4,668,929

[45] Date of Patent: May 26, 1987

[54] DEFLECTION SYSTEM FOR COLOR PICTURE TUBES

[75] Inventor: Wilfried Bernhard, Oppenheim, Fed. Rep. of Germany

[73] Assignee: Standard Elektrick Lorenz AG, Stuttgart, Fed. Rep. of Germany

[21] Appl. No.: 787,743

[22] Filed: Oct. 15, 1985

[30] Foreign Application Priority Data

Oct. 31, 1984 [DE] Fed. Rep. of Germany ..... 3439808

[51] Int. Cl.[4] ..... H01F 3/12

[52] U.S. Cl. ..... 335/211; 335/212

[58] Field of Search ..... 335/210, 212, 213, 211

[56] References Cited

U.S. PATENT DOCUMENTS 4,357,586 11/1982 Barkow et al. ..... 335/211

4,433,268 2/1984 Arisato ..... 335/211 X 4,451,807 5/1984 McGlashane et al. ..... 335/211

FOREIGN PATENT DOCUMENTS 54-18874 8/1980 Japan ..... 335/210

*Primary Examiner*—George Harris

*Attorney, Agent, or Firm*—Donald J. Lenkszus

[57] ABSTRACT

In accordance with the invention, to prevent a deflection system for a color picture tube provided with an in-line gun system from causing pincushion distortions in the east-west direction on the screen, at least two plane, thin field formers are provided for on the end face of the core for the vertical deflection coils. These field formers are made from a soft-magnetic material and are substantially in the shape of ring segments.

16 Claims, 3 Drawing Figures

DEFLECTION SYSTEM FOR COLOR PICTURE TUBES

BACKGROUND OF THE INVENTION

The invention pertains to a deflection system for color picture tubes in general and to a deflection system for a color picture tube having an in-line gun system in particular.

One such deflection system is known from the German Pat. No. 28 51 014. That system includes two deflection coils which are independent of each other. The deflection coil for the vertical deflection field is wound on a core. The field formers for forming the vertical deflection field consist of four arms. These arms, are disposed within the front area of the deflection system outside the deflection coils, and extend substantially parallel in relation to the Z-axis of the color picture tube. The arms project with one half over the deflection system, and with the other half over this system in the direction of the screen of the color picture tube and are intended to conduct the stray or leakage fluxes produced by the vertical deflection coil in such a way that the vertical deflection field exhibiting a pincushion distortion.

SUMMARY OF THE INVENTION

It is one object of the invention to provide a self-converging and distortion-free deflection system for the use with color picture tubes.

In accordance with the invention, to prevent a deflection system for a color picture tube provided with an in-line gun system from causing pincushion distortions in the east-west direction on the screen, at least two plane, thin field formers are provided for on the end face of the core for the vertical deflection coils. These field formers are made from a soft-magnetic material and are substantially in the shape of ring segments.

BRIEF DESCRIPTION OF THE DRAWING

The invention will be better understood from a reading of the following detailed description in conjunction with the drawing in which.

DETAILED DESCRIPTION

Figure 1:
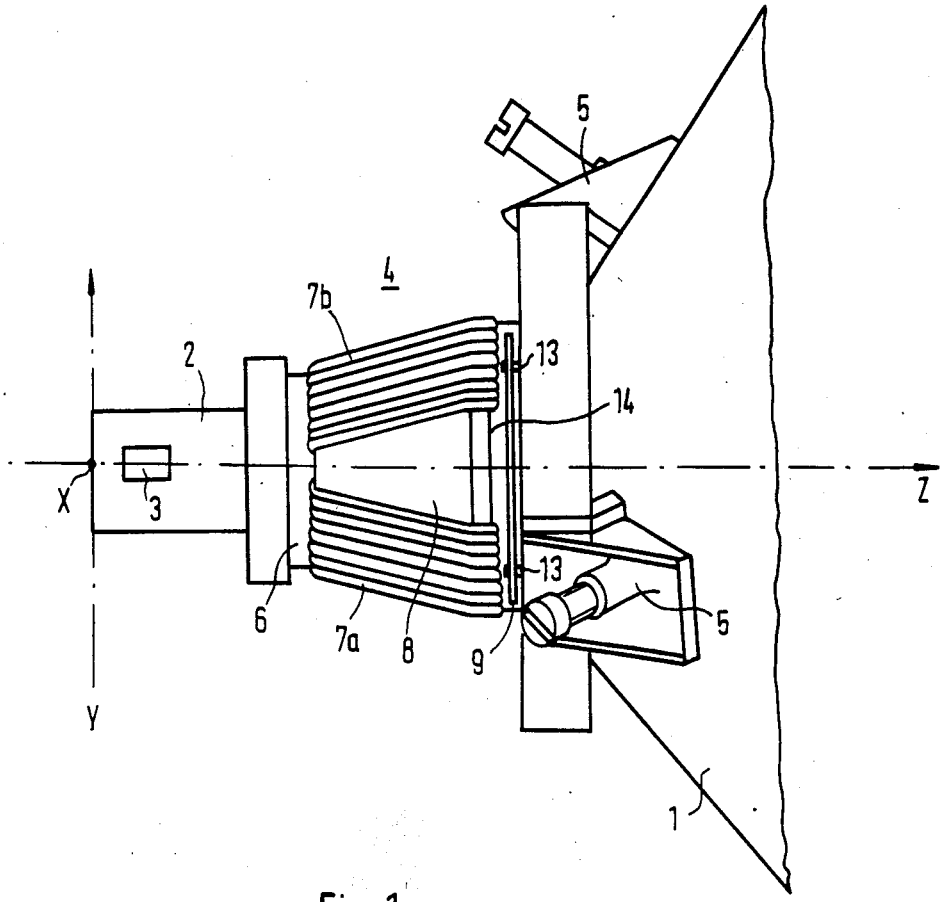
FIG. 1 is the sideview of a deflection system disposed on the neck of a color picture tube.

In FIG. 1, only a part of the cone 1 and the neck 2 of a color picture tube are shown. In-line gun system 3 is schematically denoted in the neck 2. Deflection system 4 is slipped on to the neck 2 of the color picture tube and is connected to the cone 1 of the color picture tube with the aid of adjustable mounting elements 5.

In the coordinate system shown in the drawing, the X-axis indicates the horizontal line, and the Y-axis indicates the vertical line of the color picture tube. The Z-axis is the longitudinal axis of the deflection system or of the color picture tube respectively. In FIG. 1, the X-axis is perpendicularly on the drawing plane.

The deflection system 4 comprises a deflection coil within a coilform 6 for the horizontal deflection field. The deflection coil 7 for the vertical deflection field is disposed on the coilform 6. The deflection coil 7 includes two winding halves 7*a* and 7*b* which are both wound on to a common core 8. This core is a conical toroid. In front of the end face 14 of the core 8 are two field formers 9 of which only one is visible. These plane (flat), thin field formers 9 of a soft-magnetic material are both in the same plane extending through both the X- and the Y-axis, which is perpendicular to the Z-axis. When looked at in the direction of the Z-axis, the field formers 9 are covered almost by one half by the end face 14 of the core 8. The field formers 9 are disposed mirror-symmetrically in relation to both the X- and the Y-axes, so that their centers lie on the X-axis.

Figure 2:
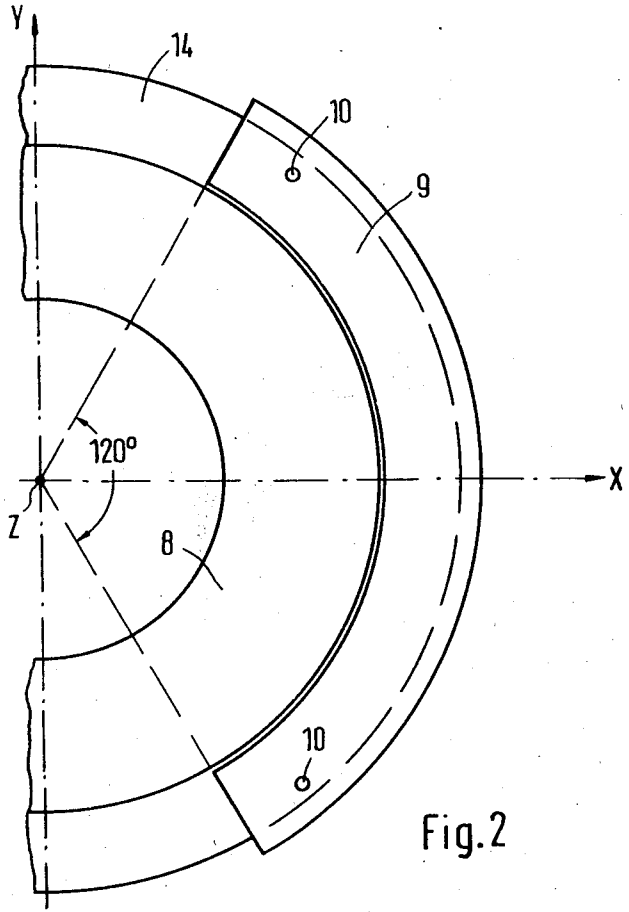
FIG. 2 is a top view of field formers.

FIG. 2 shows a first embodiment of the field formers 9 in a top view. The shown field former essentially has the shape of a ring segment, with the segment angle thereof amounting to 120°. The width of the ring segment amounts to approximately 15 mm. the field former 9 is shown in its position relative to the coordinate system in such a way as it is disposed on the end face 14 of the core 8 within the deflection system 4. This implies that the bisecting line of the segment angle coincides with the X-axis. For the sake of clarity, the core 8 is shown without the deflection coil for the vertical deflection field. The field former 9 includes one hole near each end of the ring segment. These holes 10 are engaged by pins 13 provided for on the coilform 6 and serving to keep the field formers in position within the deflection system 4 as shown in FIG. 1.

Figure 3:
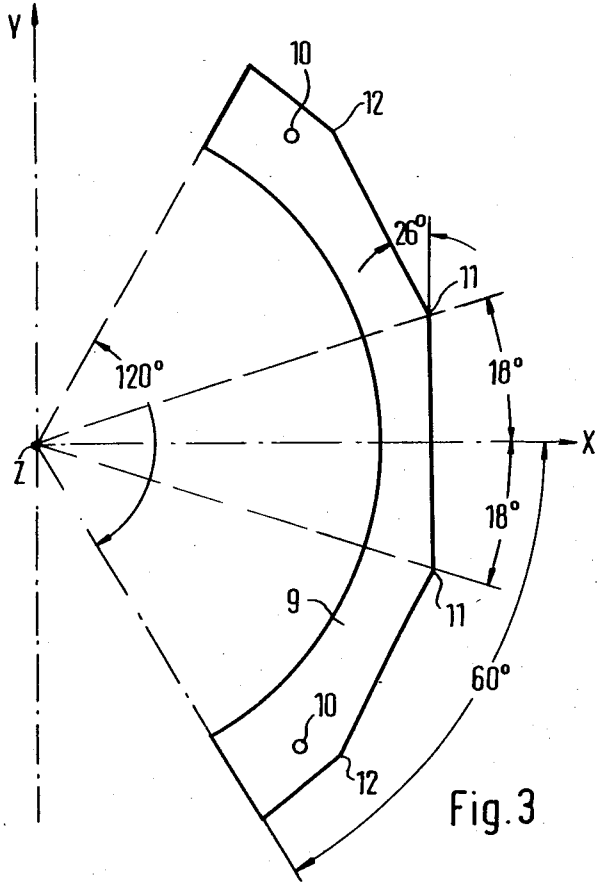
FIG. 3 is the top view of a second embodiment of the field formers.

A top view of a second embodiment of the field formers 9 is shown in FIG. 3. This type of field former has a polygonal outer contour. There are four corners which are all mirror-symmetrical in relation to the X-axis. The first pair of corners 11 is ±18° away from the X-axis, and the second pair of corners 12 is about ±45° away from the X-axis. The line connecting the corner 11 and the corner 12 forms an angle of about 26° with a line which is perpendicular to the X-axis.

The field formers 9 may also be of polygonal design on their inner contours. It is also possible for both the outer and the inner contours to have a polygonal design.

To diminish the effects of the field formers, it is also possible to cut out of the field formers 9 a segment symmetrically in relation to the X-axis. The four field formers resulting therefrom, assume within the deflection system 4 the same position as the two field formers described with reference to FIG. 1. When four field formers are used, they may also be arranged in pairs in different X-Y planes.

The deflection field produced by the vertical deflection coil is an inhomogeneous field which exhibits a pincushion distortion in the front part, and a barrel distortion in the rear part of the deflection system. This inhomogeneous field can be described by the superposition of a dipole with a sextipole and with multipoles of higher order. The field formers 9 reinforce the sectipole and the multipoles of higher order in such a way that a strong pincushion field will result in the front part of the deflection system. In this way it is achieved that there will be no pincushion distortions on the screen of the color picture tube in the X direction (east/west direction). The corners 11, 12 in the outer or the inner contours of the field formers respectively, reinforce the multipoles of higher order.

What is claimed is:

1. A deflection system for a color picture tube having an in line gun system, said deflection system being on the outside around the neck of said color picture tube, said deflection system comprising:

a first deflection coil;

a core;

a vertical deflection coil independent of said first deflection coil and wound on said core;

a plurality of field formers of soft magnetic material being disposed in the proximity of the front side of said core, said field formers having the general shape of a planar ring segment, at least two field formers of said plurality of field formers being disposed in front of the end face of said core within the vertical deflection field such that the planes of said two field formers lie in the X-Y plane, said two field formers being disposed in mirror symmetry relative to both X and Y axes.

2. A deflection system in accordance with claim 1 wherein all of said plurality of field formers lie substantially in one X-Y plane of the deflection system.

3. A deflection system in accordance with claim 1 wherein:

each of said two field formers extends over approximately 120 degrees of arc and each has its center on the X axis.

4. A deflection system in accordance with claim 1, wherein:

each of said field formers has a polygonal outer contour.

5. A deflection system in accordance with claim 4, wherein:

the corners of said polygonal outer contour of each said field former are disposed in mirror symmetry relative to said X axis.

6. A deflection system in accordance with claim 5, wherein:

said corners are positioned at approximately ±18° and ±45° relative to said X axis.

7. A deflection system in accordance with claim 1, wherein:

each of said field formers has a polygonal inner contour.

8. A deflection system in accordance with claim 1, comprising: four field formers.

9. A deflection system in accordance with claim 2, wherein:

each of said field formers has a polygonal outer contour.

10. A deflection system in accordance with claim 9, wherein:

the corners of said polygonal outer contour of each said field former are disposed in mirror symmetry relative to said X axis.

11. A deflection system in accordance with claim 10, wherein:

said corners are positioned at approximately ±18° and ±45° relative to said X axis.

12. A deflection system in accordance with claim 3, wherein:

each of said field formers has a polygonal outer contour.

13. A deflection system in accordance with claim 12, wherein:

the corners of said polygonal outer contour of each said field former are disposed in mirror symmetry relative to said X axis.

14. A deflection system in accordance with claim 13, wherein:

said corners are positioned at approximately ±18° and ±45° relative to said X axis.

15. A deflection system in accordance with claim 2, wherein:

each of said field formers has a polygonal inner contour.

16. A deflection system in accordance with claim 3, wherein:

each of said field formers has a polygonal inner contour.

* * * * *